US006615442B2

(12) United States Patent
Yang

(10) Patent No.: US 6,615,442 B2
(45) Date of Patent: Sep. 9, 2003

(54) VACUUM CLEANER

(75) Inventor: Byung-Sun Yang, Changwon Gyeongnam (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/875,000

(22) Filed: Jun. 7, 2001

(65) Prior Publication Data

US 2002/0083550 A1 Jul. 4, 2002

(30) Foreign Application Priority Data

Dec. 29, 2000 (KR) ..... 2000-85641

(51) Int. Cl.[7] ..... A47L 5/00
(52) U.S. Cl. ..... 15/323
(58) Field of Search ..... 15/323, 339, 352

(56) References Cited

U.S. PATENT DOCUMENTS 2,232,548 A * 2/1941 McAnerney ..... 15/246.2
2,850,756 A * 9/1958 Ziegler et al. ..... 15/323
2,876,479 A * 3/1959 Kaufman ..... 15/246.4
4,697,299 A * 10/1987 Brinkhoff et al. ..... 15/323
4,835,814 A * 6/1989 Bonnet ..... 15/339
5,125,127 A * 6/1992 Bach et al. ..... 15/323
5,142,731 A * 9/1992 Resch ..... 15/323
6,058,558 A * 5/2000 Kim ..... 15/323
6,058,559 A * 5/2000 Yoshimi et al. ..... 15/323

* cited by examiner

*Primary Examiner*—Terrence R. Till
(74) *Attorney, Agent, or Firm*—Fleshner & Kim, LLP

(57) ABSTRACT

The present invention relates to a hook retention portion of vacuum cleaner. The vacuum cleaner of the present invention comprises a cleaner body with a motor installed therein; a dust collector engaged detachably in the rear of the cleaner body; and a suction hole portion for guiding air, introduced by the motor, into the cleaner. Further, in the present invention, the suction hole portion is formed with a projecting hook portion, and a hook retention portion for engaging the projecting hook portion therewith is formed in the dust collector, whereby the suction hole portion can be hung on the dust collector. Furthermore, the hook retention portion of the dust collector is formed at a handle that is prominently formed at a rear face of the dust collector. According to the constitution of the present invention, the suction hole portion can be more easily stored on the body of the vacuum cleaner wherein the dust collector is mounted to the rear face of the cleaner body.

13 Claims, 2 Drawing Sheets

VACUUM CLEANER

TECHNICAL FIELD

The present invention relates to a vacuum cleaner, and more particularly, to a vacuum cleaner constructed in such a manner that an extension tube, to which a suction portion is mounted at an end thereof, can be fixed to a cleaner body in a coupling state.

BACKGROUND ART

The vacuum cleaner is constructed to include a body in which a suction device such as a motor is installed, a connecting hose which is detachable from the body, and an extension tube which is connected to an end of the connecting hose. Further, a suction portion is mounted to an end of the extension tube. Suction support appliance is defined to include an extension tube and a suction portion.

In general, such suction support appliance is mounted to the cleaner body while it is not used. Further, in a conventional cleaner, the extension tube is generally mounted and fixed to a front or lateral face of the cleaner body when the tube is mounted to the cleaner body.

On the other hand, in a vacuum cleaner constructed in such a manner that a dust collector is mounted detachably to a rear face of the cleaner body, it is an important point where to mount the suction support appliance while the cleaner is not used. Further, it is very inconvenient to place or store the cleaner in such a state that the rear face of the cleaner body faces toward a bottom floor as in the conventional cleaner, since the dust collector exists in the rear face of the cleaner body. Therefore, the cleaner is usually stored in a state of general use. In such a case, it is not easy to properly mount the suction support appliance to the cleaner body.

SUMMARY OF INVENTION

The object of the present invention is to provide a vacuum cleaner having a constitution that a dust collector can be detachably mounted to a rear end of the cleaner and a suction support appliance can be more conveniently inserted and fixed to a cleaner body.

The vacuum cleaner of the present invention for achieving the above object comprises a cleaner body with a suction means installed therein; a dust collector mounted detachably in the rear of the cleaner body; and a suction support appliance for guiding air, introduced by the suction means, into the cleaner. Further, the suction support appliance is formed with a projecting hook portion, and a hook retention portion for engaging the projecting hook portion therewith is formed in the dust collector, whereby the suction support appliance can be hung on the dust collector.

According to an embodiment of the present invention, the hook retention portion of the dust collector is formed at a handle that is prominently formed at a rear face of the dust collector.

According to another embodiment of the present invention, the hook retention portion includes a groove that is opened upward, and the projecting hook portion includes an insert that is inserted into the groove.

DETAILED DESCRIPTION OF THE PREFERRED EMBODIMENT

Hereinafter, preferred embodiments of the present invention will be explained in detail with reference to the drawings.

Figure 1:
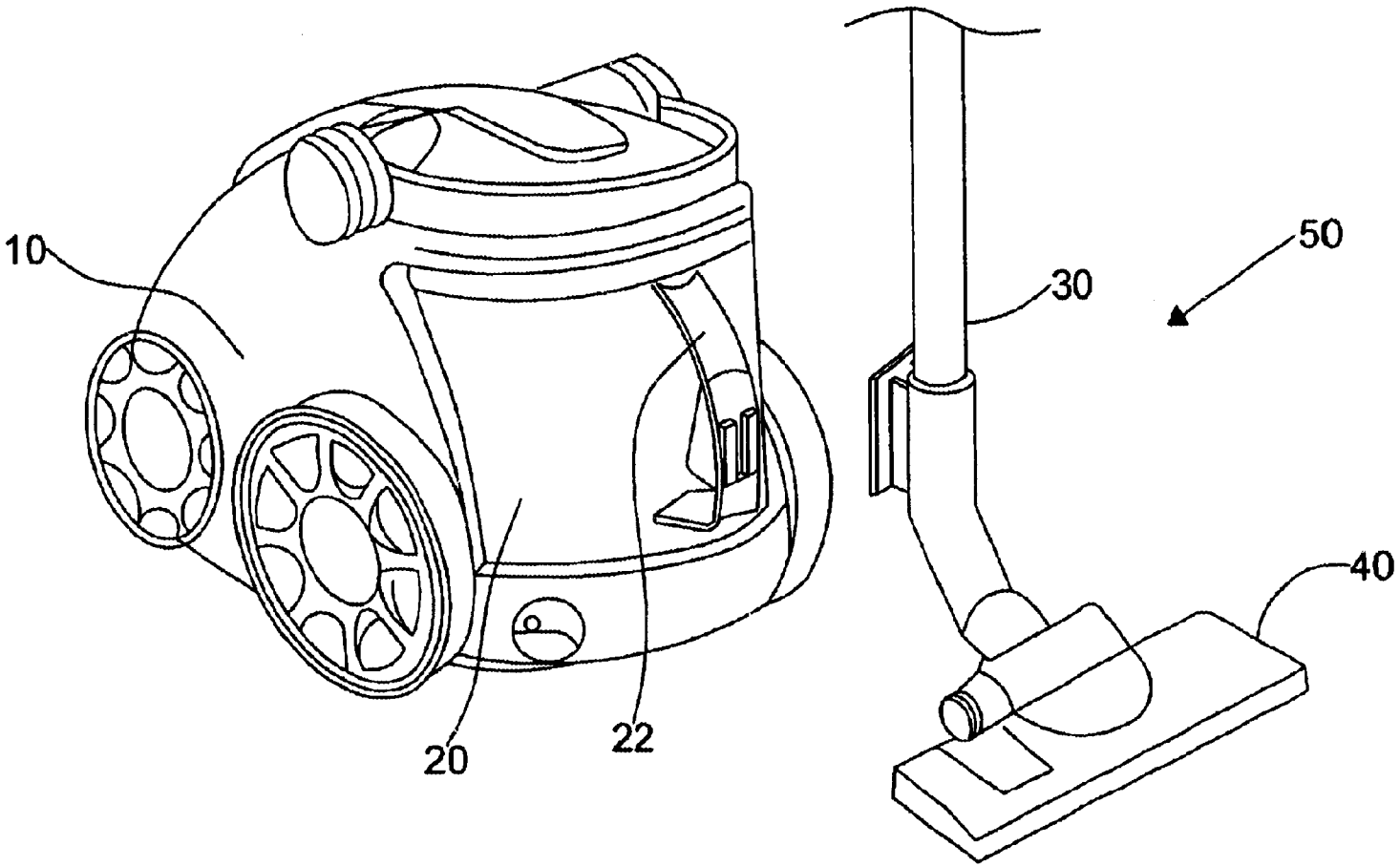
FIG. 1 is a perspective view of a vacuum cleaner according to the present invention.

As shown in FIG. 1, a vacuum cleaner according to the present invention is constructed to include a cleaner body 10, a dust collector 20 mounted detachable to a rear portion of the cleaner body 10, and a suction support appliance 50 having a constitution which is detachably mounted to the dust collector 20. A suction support appliance or device 50 includes an extension tube 30 and a suction portion 40.

A suction device, such as a motor and so forth, for generating a suction force is installed within the cleaner body 10, and the vacuum cleaner can generate the suction force. Further, the dust collector 20 is used for filtering dust from dust-containing air introduced by the suction force of the vacuum cleaner. The dust collector 20 primarily has a function of collecting the dust in accordance with a cyclonic method, and secondarily includes a dust-collecting filter for filtering fine dust. Further, a handle 22, by which a user grips the dust collector 20 during its insertion or removal, is formed in the rear of the dust collector 20.

In the present invention, it is a main technical feature that the suction support appliance 50 is constructed to be detachably mounted to the dust collector 20.

Figure 2:
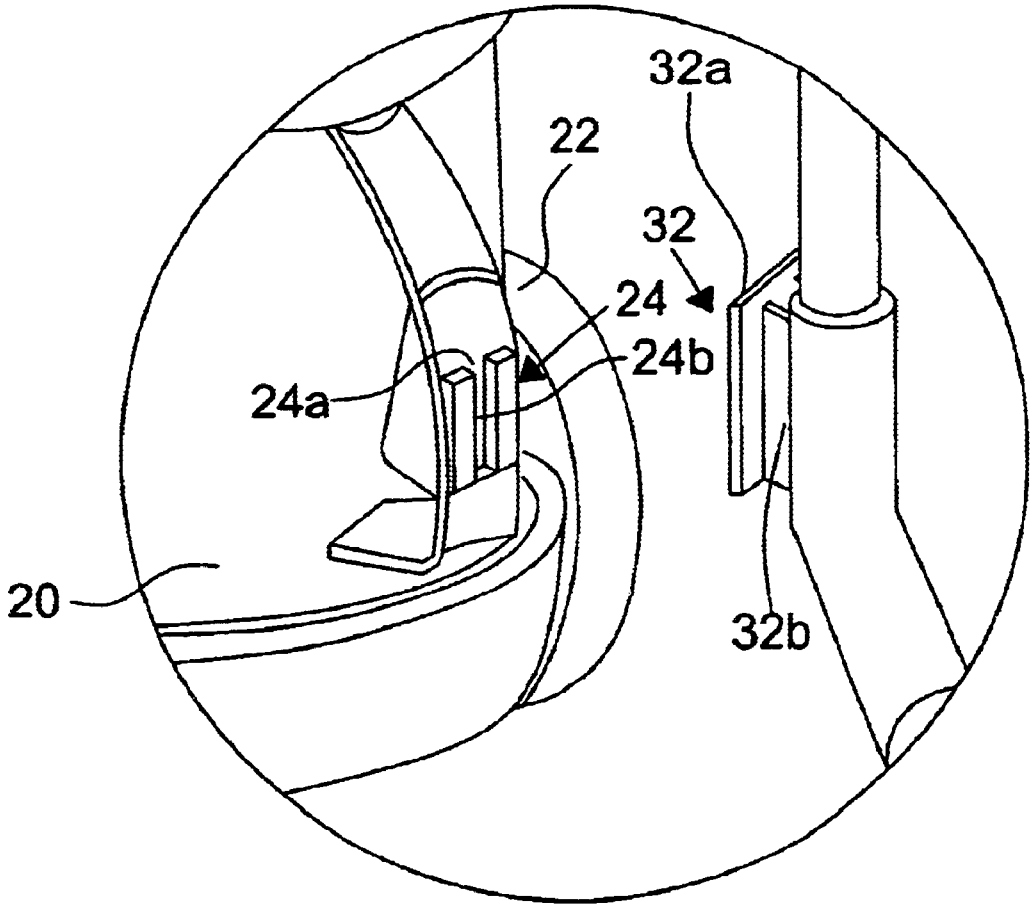
FIG. 2 is an exploded perspective view of principal parts of the vacuum cleaner according to the present invention.

In addition, FIG. 2 shows an embodiment of the present invention wherein the handle 22 of the dust collector 20 is formed with a hook retention portion 24 for engaging a projecting hook portion 32 of the extension tube 30 therewith. That is, the handle 22 of the dust collector 20 is formed with an upwardly opened groove 24*a* and a slot 24*b* that is slit in the rear of the groove 24*a* along the longitudinal direction. As an embodiment for the substantial formation of the hook retention portion 24 according to the present invention, the above constitution having the groove 24*a* and the slot 24*b* is described herein.

Further, the projecting hook portion 32, by which the suction support appliance 50 is hung on the cleaner body 10 by inserting the projecting hook portion into the hook retention portion 24, is formed in suction support appliance 50 includes an extension tube 30 and a suction portion 40. The projecting hook portion 32 is constructed to have a T-shaped horizontal cross section, and comprises an insert 32*a* that is inserted into the upwardly opened groove 24 and a relatively narrow connecting portion 32*b* for connecting the insert 32*a* with the suction support appliance 50.

Therefore, the projecting hook portion 32 of the suction support appliance 50 can be hooked into the hook retention portion 24 formed in the handle 22 of the dust collector 20. Consequently, the suction support appliance 50 can be mounted to the cleaner body as a whole, and thus the condition as such can be maintained.

Considering a process of inserting the projecting hook portion 32 into the hook retention portion 24, the insert 32*a* of the projecting hook portion 32 is inserted downwardly from above into the upwardly opened groove 24*a*. At this time, the connecting portion 32*b* in the rear of the insert 32*a* is received in the slot 24*b* of the hook retention portion 24. Further, since a lower portion of the upwardly opened groove 24*a* is blind, the insert 32*a* can be received in the groove 24*a* and can be perfectly hooked therein.

It is needless to say that the projecting hook portion 32 and the hook retention portion 24 can be variously changed or modified. For example, it is most preferred that the projecting hook portion 32 be constructed to include the downwardly extending insert 32*a,* and that the hook retention portion 24 be constructed as the upwardly opened groove 24*a.* Of course, the other modifications or changes thereof can be made within the scope of the technical features as such.

Therefore, the cleaner according to the present invention can be conveniently stored merely by inserting the suction support appliance 50 of the cleaner into the dust collector 20 of the cleaner body 10.

According to the present invention constructed as such, the suction support appliance 50 connected to the suction portion of the vacuum cleaner can be very conveniently mounted to the dust collector of the cleaner body. Therefore, the extension tube can be most conveniently mounted on the cleaner wherein the dust collector is mounted in the rear of the cleaner body.

According to the present invention described above, it is a fundamental technical feature to construct the vacuum cleaner in such a manner that the suction support appliance 50 includes an extension tube and a suction portion can be hung on the dust collector. Although the present invention has been illustrated and described with reference to the preferred embodiment of the present invention, various changes, modifications and additions to the present invention will be apparent to those skilled in the art without departing from the spirit and scope of the present invention.

What is claimed is:

1. A vacuum cleaner, comprising:

a cleaner body with a suction means installed therein;

a dust collector engaged detachably in the rear of said cleaner body; and a suction device for guiding air sucked by said suction means, into said cleaner, wherein said suction device is formed with a projecting hook portion, and a hook retention portion for engaging said projecting hook portion therewith is formed in said dust collector, whereby said suction device can be hung on said dust collector.

2. The vacuum cleaner as claimed in claim 1, wherein said hook retention portion of said dust collector is formed on a handle that is prominently formed on a rear face of said dust collector.

3. The vacuum cleaner as claimed in claim 1, wherein said hook retention portion includes a groove that is open upwardly, and said projecting hook portion includes an insert that is inserted into said groove.

4. The vacuum cleaner as claimed in claim 1, wherein said projecting hook portion is formed on an extension tube.

5. The vacuum cleaner as claimed in claim 1, wherein said projecting hook portion is formed on a suction portion.

6. A vacuum cleaner, comprising:

a cleaner body;

a dust collector configured to be detachably attached to the cleaner body and having a first attachment component; and a suction device having a second attachment component configured to detachably mate with the first attachment component to detachably attach the suction device to the cleaner body, wherein the dust collector includes a handle and the first attachment component is formed on the handle.

7. The vacuum cleaner as claimed in claim 6, wherein the suction device includes an extension tube on which the second attachment component is provided.

8. A vacuum cleaner, comprising:

a cleaner body;

a dust collector configured to be detachably attached to the cleaner body and having a first attachment component; and a suction device having a second attachment component configured to detachably mate with the first attachment component to detachably attach the suction device to the cleaner body, wherein the first attachment component includes a groove that opens outwardly with respect to a central longitudinal axis of the cleaner body, and the second attachment component includes an insert configured to be inserted into the groove.

9. A vacuum cleaner, comprising:

a cleaner body;

a dust collector configured to be detachably attached to the cleaner body and having a first attachment component; and a suction device having a second attachment component configured to detachably mate with the first attachment component to detachably attach the suction device to the cleaner body, wherein the dust collector is provided on a rear portion of the cleaner body.

10. Apparatus for fastening a suction device to a vacuum cleaner having a cleaner body and a dust collector detachably attached to the cleaner body, the apparatus comprising:

a first attachment component provided on the suction device and configured to detachably mate with a second attachment component provided on a handle of the dust collector.

11. The vacuum cleaner as claimed in claim 10, wherein the suction device includes an extension tube on which the first attachment component is provided.

12. Apparatus for fastening a suction device to a vacuum cleaner having a cleaner body and a dust collector detachably attached to the cleaner body, the apparatus comprising:

a first attachment component provided on the suction device and configured to detachably mate with a second attachment component provided on the dust collector, wherein the second attachment component includes a groove that opens outwardly with respect to a central longitudinal axis of the cleaner body, and the first attachment component includes an insert configured to be inserted into the groove.

13. Apparatus for fastening a suction device to a vacuum cleaner having a cleaner body and a dust collector detachably attached to the cleaner body, the apparatus comprising:

a first attachment component configured to be mounted on a handle of the dust collector; and a second attachment component configured to be mounted on the suction device and detachably mate with the first attachment component to detachably attach the suction device to the cleaner body.

* * * * *